United States Patent [19]

Delamare

[11] Patent Number: 4,480,575

[45] Date of Patent: Nov. 6, 1984

[54] DEVICE FOR RAPIDLY MOORING A FLOATING INSTALLATION TO AN ANCHORED MARINE INSTALLATION

[75] Inventor: Guy R. Delamare, Herblay, France

[73] Assignee: Institut Francais du Petrole, Rueil-Malmaison, France

[21] Appl. No.: 391,026

[22] Filed: Jun. 22, 1982

[51] Int. Cl.[3] ..... B63B 21/52

[52] U.S. Cl. ..... 114/230; 441/5

[58] Field of Search ..... 114/230, 220; 441/1, 441/3-5; 308/216

[56] References Cited

U.S. PATENT DOCUMENTS

| | | | |
|---|---|---|---|
| 1,967,650 | 7/1934 | Ahmansson | 308/216 |
| 2,034,545 | 3/1936 | Umstattd | 308/216 |
| 3,155,069 | 11/1964 | Ross et al. | 441/3 |
| 3,354,479 | 11/1967 | Uoppenol et al. | 441/5 |
| 3,908,212 | 9/1975 | van Heijst | 441/5 |
| 3,961,490 | 6/1976 | Corgnet | 114/230 |
| 4,114,556 | 9/1978 | Orndorff et al. | 114/230 |
| 4,193,368 | 3/1980 | De Graaf et al. | 114/230 |
| 4,281,611 | 8/1981 | Vilan | 441/5 |
| 4,396,046 | 8/1983 | Kentosh | 441/5 |

FOREIGN PATENT DOCUMENTS

| | | | |
|---|---|---|---|
| 1403493 | 5/1965 | France . | |
| 2394443 | 1/1979 | France | 114/230 |
| 2442759 | 6/1980 | France | 114/230 |

OTHER PUBLICATIONS

McGraw-Hill Dictionary of Scientific and Technical Terms, p. 7 Webster's New World Dictionary of the American Language, Second College Edition, p. 6.

*Primary Examiner*—Trygve M. Blix
*Assistant Examiner*—Stephen P. Avila
*Attorney, Agent, or Firm*—Millen & White

[57] ABSTRACT

A device for rapidly mooring a floating installation to a marine installation fastened to the ocean bottom includes a rigid connecting arm horizontally articulated at one end at a connection to the floating installation. The other end of the arm includes a connector having guides for being retained on a pathway of the marine installation. To effect retention of the guides on the pathway, the connector also includes a temporary separation mechanism which urges the guides away from the marine installation pathway to enable effecting connection with the connector, whereupon the separation mechanism brings the guides in contact with the pathway. To effect separation, the mechanism is adapted for reverse operation.

17 Claims, 5 Drawing Figures

DEVICE FOR RAPIDLY MOORING A FLOATING INSTALLATION TO AN ANCHORED MARINE INSTALLATION

BACKGROUND OF THE INVENTION

The present invention concerns a device for rapidly mooring a floating installation to a marine installation having a substantially stationary position relative to the water bottom and to which the floating installation is connected by means of a rigid arm.

The floating installation may be a ship and the marine installation a mooring buoy anchored at a predetermined distance from the shore. The marine installation can also be a tower, a "duc d'albe", an oscillating column, a caisson, a reservoir, etc. It can also be a buoy for loading and/or unloading cargo of a ship, an installation whereform are performed or controlled such operations as drilling of the sea bottom, recovering oil petroleum products, etc. The floating installation can also be a center for recovering thermal energy from the sea or a floating plant for treating and storing petroleum products.

There are already known systems for mooring ships to a structure such as a buoyant caisson, or to an oscillating column, which employ pivoting arms. Systems of this type are, for example, described in French Pat. No. 1,403,493 and in U.S. Pat. Nos. 3,354,479 and 3,908,212. In these systems, the mooring structure is surmounted by a rigid arm integral with the ship and in the extension of its stem on which it is articulated so as to accommodate pitching movements. To permit rotation of the arm and of the ship about the vertical axis of the mooring structure, the connection of the arm to this structure is accomplished by means of a pivot provided with ball bearings or roller bearings, this pivot making up a rotary table or orientation ring.

These prior art devices present a major inconvenience in that they do not permit the rapid mooring and release of ships on rough water, by means making up part of the ship itself. In effect, the assembly between the arm integral with the ship and the marine installation employing a rotating table regularly requires provision of means for raising or lifting exterior to the ship, which are very awkward and burdensome, and the precise positioning required can only be accomplished on a calm water surface. Generally, this assembly is effected in a shipyard on the plane of a flat water surface and the assembly formed by the buoy, the arm and the ship are towed just to the site where the system is used to proceed with the anchoring. The anchoring procedures of such an assembly are very delicate, requiring the coordination of a plurality of tows and service boats and should be effected during a meterological "window" of significant size. On the other hand, the use of the device in accordance with the invention, which makes possible a rapid mooring on the ocean of a ship to the buoy or to the oscillating column permits the accomplishment of the putting in place of the installation in two phases: the first being a classical operation of anchoring the buoy or putting in place the oscillating column, the second is a rapid operation of attaching the ship to the buoy or the oscillating column already anchored.

The use of the device in accordance with the invention likewise permits the rapid decoupling between the ship and buoy leaving the latter in place, without deterioration of the principal elements which make up the mooring device, as opposed to the manner of the device in accordance with French Pat. No. 2,442,759, wherein the rapid decoupling results in the destruction of the straps thereof. This possibility offered by the present invention is new with respect to the presently known devices and is of great interest for use with floating installations which are moored to marine installations, especially those dedicated to the exploitation of underwater petroleum, from the regions of the world wherein the ocean is relatively calm throughout the entire year (the Gulf of Mexico, Indonesia), but where there occurs from time to time a severely extreme perturbation (a hurricane, for example). Such occasional perturbations exert on these installations which should rest in place, as is the case with the present technique, forces without equal when measured against those forces which result from the regular oceanic conditions. It is desirable in this case to momentarily interrupt the exploitation and to free the ship and to leave only the bouy at the site, said bouy representing in general a mass 100 times smaller than that of the ship. It is also extremely desirable for repair work on the alone to be performed at a shipyard on the ship instead of restoring to be able to set out only one naval slip way, before restoring the ship assembly, arm and buoy on the slip way, after having released the anchoring lines and the ties to the bottom.

Finally, the present invention, contrary to the device according to French Pat. No. 2,394,443, avoids utilization of connecting lines which serve to guide the ship for effecting the mooring.

SUMMARY OF THE INVENTION

The principle object of the invention is to realize a new rotating device for realizing the connection of a ship to a marine installation fastened to at least one fixed point on the bottom of the ocean, with the aid of a rigid arm which permits the rapid mooring and release of the ship in open ocean without other means than those carried by the ship.

In this device, one of the extremities of the rigid arm is attached to the ship by an articulation means whose axis is horizontal for permitting the lowering or the raising of the same arm, and the other extremity carries a connecting means, equipped with guiding means which cooperate with a rolling pathway equipped on the marine installation. The connecting means comprises means for temporarily separating or pulling away the guiding means, so as to permit either the berthing and then the retaining of the connecting means on the rolling pathway, after the lowering of the rigid arm with a view toward mooring, or granting the freeing of the connecting means for permitting the raising of the rigid arm while releasing the marine installation.

BRIEF DESCRIPTION OF THE DRAWINGS

The characteristics and advantages of the invention will be better understood upon a reading of the description which is one embodiment of the device and refers to the attached drawings, wherein.

DETAILED DISCUSSION OF THE INVENTION

Figure 1:
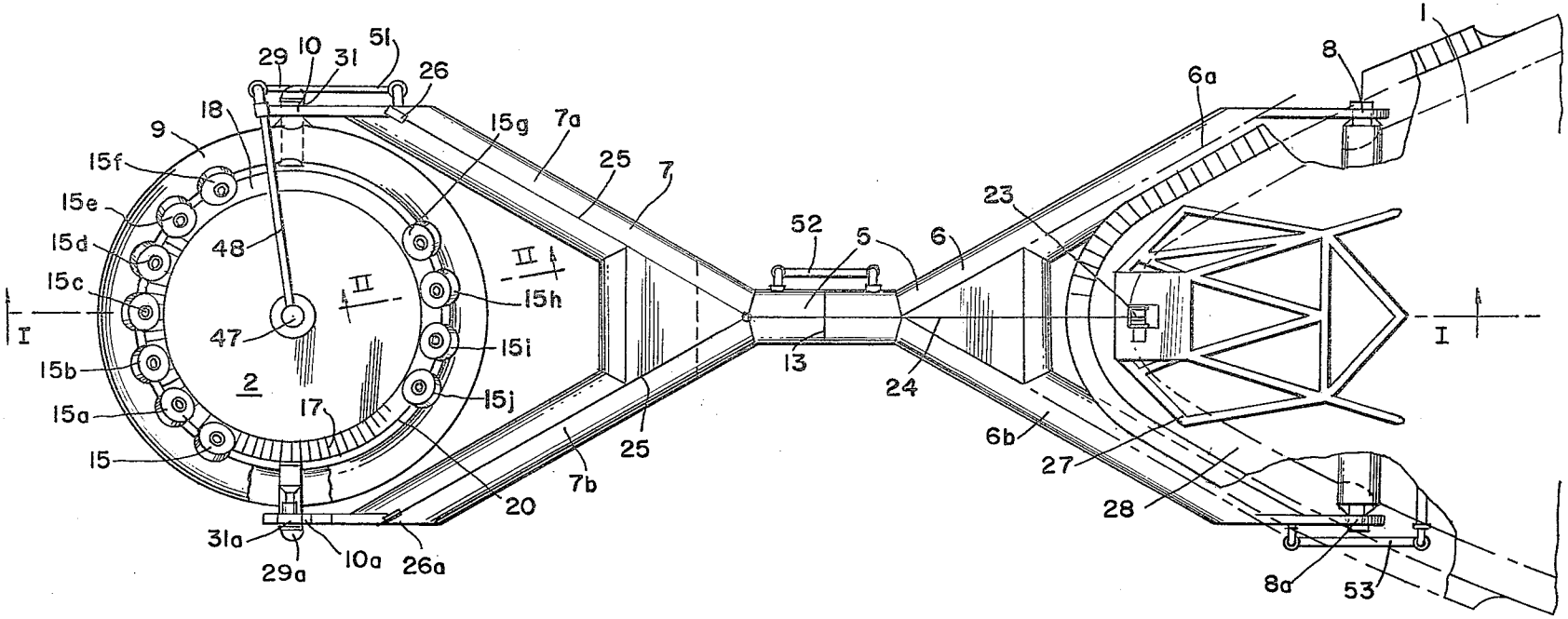
FIG. 1 is a top plan view of one embodiment of the device according to the invention, certain details are represented in cross-section along a horizontal line.
Figure 2:
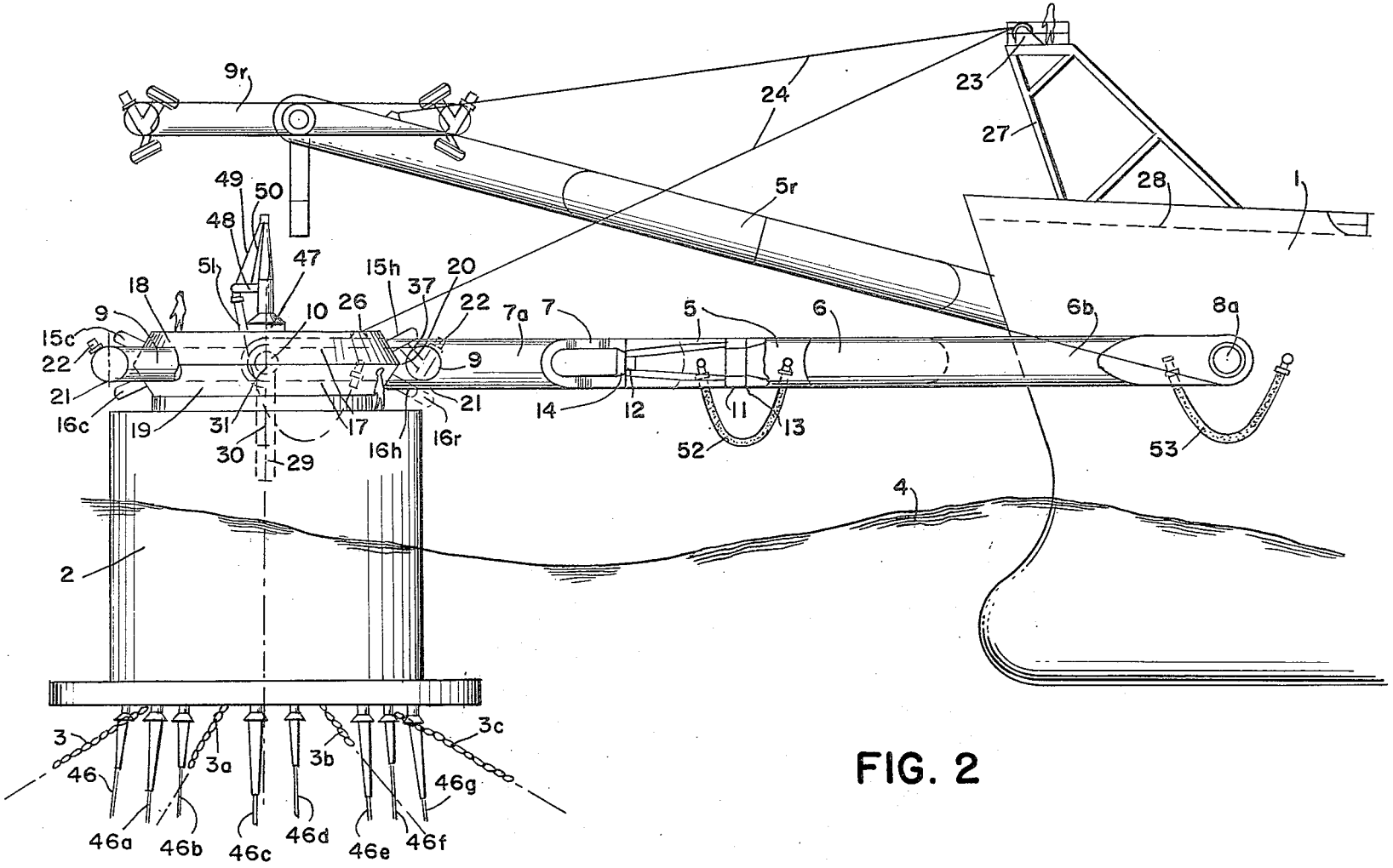
FIG. 2 is an elevation view in partial cross-section along line I of FIG. 1 of the embodiment thereof.
Figure 3:
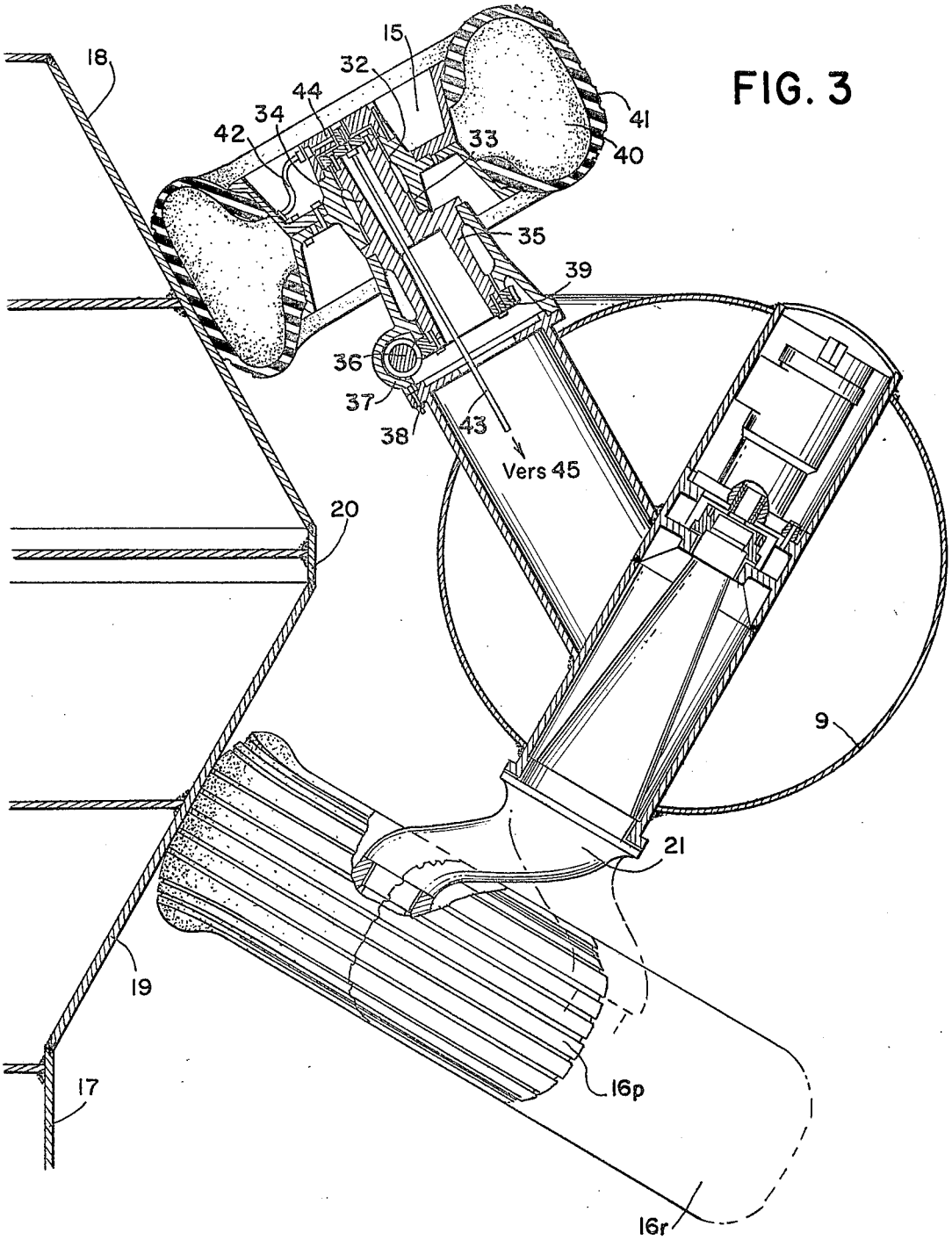
FIG. 3 is a view in cross-section along line II of FIG. 1.

In FIGS. 1, 2 and 3 there is represented one embodiment of the device for mooring and releasing according to the invention where a floating installation 1, such as a ship, which is moored about a marine installation 2 such as a floating buoy, fastened to the bottom of the ocean by funicular anchor lines 3, 3*a*, 3*b*, 3*c*, the level of the ocean being schematisized by line 4.

The device comprises a rigid arm 5 in the form of a cross that is composed of two forks 6 and 7. The two branches 6*a* and 6*b* of fork 6 hold in princer form the extremity of the floating installation 1 whereon the arm is articulated along a substantially horizontal axis with the aid of bearings 8 and 8*a*. The two branches 7*a* and 7*b* of the fork 7 hold in princer form a connecting means constituted by a circular ring 9, advantageously in the form of a curved steel tube, on which the arm can be articulated along the substantially horizontal axis with the aid of bearings 10 and 10*a*.

The two forks 6 and 7 constitute two portions of the rigid arm which are an extension one of the other, arranged in a fashion so as to permit coaxial rotation of one of the portions with respect to the other, by two axial bearings 11 and 12, and two abuttments 13 and 14 which absorb the traction and compression forces applied on the rigid arm by the movements of the floating installation 1 with respect to the marine installation 2.

The circular ring 9 supports guiding means, advantageously constituted by two trains of pneumatic wheels 15 to 15*j* and 16 to 16*j*, which cooperate with a circular structure constituting a rolling pathway 17 which, in the example illustrated, is shaped in the form of a flanged collar on the buoy 2. In the example illustrated by FIGS. 2 and 3, this circular structure 17 comprises two superposed truncated conical walls 18 and 19 arranged opposed at their base so as to form a projecting circular ridge or crest 20. Thus, in the illustrated example, the rolling pathway is constituted by two rolling tracks respectively referenced 18 and 19.

The circular ring 9 is to be positioned around the biconical structure 17, on the plane of the ridge 20, in such a fashion that the wheels 15 to 15*j* mounted on the upper portion of the ring and distributed on its circumference, but more particularly disposed near the exterior and near the interior of the arm for absorbing the forces exerted upon bringing the ship near the buoy and separating the ship from the buoy, which are preferably applied perpendicular to the upper conical wall 18. The wheels 16 to 16*j* mounted on the lower portion of the ring and distributed in the same fashion as wheels 15 to 15*j* engage preferably perpendicularly the lower conical wall 19.

The wheels 16 to 16*j* are attached to the ring 9 by means of an eccentric axle 21 for allowing rotation, controlled advantageously by a hydraulic actuating means 22, so as to effectively pull them away or bring them close to the wall 19. It can be seen in FIG. 3 that the wheel 16 in the position 16*p*, is urged against the wall 19 by a prerestraint which produces a deformation of the tire whereas in the position 16*r*, it is separated from the wall 19 towards the exterior of the biconical structure 17 on the other side of the projecting circular ring 20. Since the wheels 16 to 16*j* are in the close position 16*p*, there is obtained a locking of the catch of the arm 5 on the buoy 2. On the other hand, the separation in the position 16*r* permits the lowering, and the raising of the arm 5.

FIG. 2 likewise shows the rigid arm 5 in the position 5*r* and the ring 9 in the position 9*r*, positions that they occupy either before mooring the ship 1 to the buoy 2 or after releasing from said buoy.

The maneuver which permits the mounting or lowering of the arm between the two positions 5 and 5*r* is controlled by winch 23 which winds or unwinds cable 24 extended by a connecting lug whereon the two sides of the cable 25 and 25*a* are attached on the two branches 7*a* and 7*b* of the fork on the forward portion 7 of the arm by means of straps 26 and 26*a*. For diminishing the force of traction on the cable due to the mass of the arm, the winch is mounted on a raised structure 27 installed on the forward deck 28 of the ship 1. To facilitate the operation of mounting the tires of the wheels 15 to 15*j* on the conical upper wall 18 of the circular structure 17, the ring 9 which, in the embodiment illustrated comprises an axis of rotation can be maintained substantially horizontal during the maneuvers of lowering and raising the arm 5 for lowering its center of gravity, thanks to ballasts 29 and 29*a* suspended at the end of arm 30 fixed to the ring 9 articulated at 31 and 31*a*, ballasts which confer to the ring 9 a perpendicular stability.

In FIG. 3, there is represented in detail an example of the mechanism which attaches each of the wheels 15 to 15*j* to the ring 9. The wheel 15, represented therein equipped with sleeve bearings 32 and 33, can turn about the axle on 34 which extends the axle 35 whose axis is off center with respect to the axis of the suspension 34 in an eccentric manner, in such a fashion that the rotation of the axle 35 in one direction permits removal of said wheel from the conical wall 18 which constitutes the rolling pathway, whereas the rotation in the other direction permits the application anew against said wall. This disposition provides the possibility, when the liason between the buoy and the ship is established, of replacing a damaged wheel during a fixed state period of the ocean. The assembly of wheels 15 to 15*j* are in working position supported on the rolling pathway constituted by the wall 18, the mechanism described permits the separation of one of them for effecting its removal and replacement. It will be clear that it is the same for wheels 16 to 16*j* wherein the eccentric axles 21 which serve principally to lock the ring of arm 5 on the biconical structure 17 of the buoy 2, can also be utilized for separating one of them from the rolling pathway, for effecting its removal and replacement.

The command of rotation to the axle 35 can advantageously be effected by means of maneuvering of the endless screw 36 implanted within the interior of housing 37 fixed on the structure of the ring 9 by pins 38 etc. This endless screw is actuated by the toothed wheel 39 which is integral with the axle 35.

The maneuver of the endless screw 36 can be effectuated manually or by electric motor or hydraulic motor not represented.

Moreover, each of the chambers 40 of tires 41 of the wheels 15 are connected by means of pipes 42 and 43 and with turning joint 44 with a common center for generating and regulating the pressure, with the object of adjusting the charges which are applied to the tires as a function of the state of the ocean.

The operation of the system above described is easy to comprehend.

The buoy 2 having been previously anchored at the site, the ship 1 is presented for being moored thereto. The ship is equipped with its rigid arm 5 which is suspended in position 5*r* by cable 24. The ship maneuvers so as to position the ring 9, suspended by the arm, over the buoy 2. The wheels 16 through 16*j* mounted on the lower part of the ring 9 having been previously placed in position 16*r* by means of the rotating command of the hydraulic actuators 22, in such a manner that they define a circle greater than the circle defined by the edge 20 of the two conical walls 18 and 19 of the structure 17 surmounted on the buoy. In this manner, the rigid arm can be lowered by the winch 23 from the position 5*r* to position 5 just to the point of contact of the wheels 15 to 15*j* on the upper conical wall 18. At that moment, wheels 16 to 16*j* located in a position facing the wall 19 below the edge 20 and there can be effected the locking of the ring 9 on the structure 17 by means of the command of hydraulic actuators 22 which, cause rotation of the eccentric axle 21 so as to apply them against the wall 19 with compression of the tires.

During the lowering movement of the arm 5, the ring 9 which carries the tires and comprises a horizontal axis of rotation can be maintained in a substantially horizontal position thanks to ballasts 29 and 29*a* which give a perpendicular stability thereto and assure in calm ocean conditions a quasi-simultaneous contact of the tires of the wheel 15 to 15*j* on the wall 18 that receives them. At the same time, the resilience of the tires and the conical form of the structure receiving them permits effecting this attaching maneuver under good conditions likewise, if the buoy 1 and the ship 2, subjected to swells are moved by light movements one with respect to the other, and if the ring g is not precisely in position on the axis of the buoy at the moment of impact. After contacting of the upper wheels 15 to 15*j* with the rolling pathway 18 and after locking the lower wheels 16 to 16*j* in their position of operation by remote control from the ship, the mooring of the ship to the buoy is achieved. From that time onwards, under the combined effects of the wind, the current, and waves, the ship undergoes the forces which tend to separate it from the buoy. These traction forces are transmitted to the buoy by pressure on the conical walls 18 and 19 through wheels 15 to 15*f* and 16 to 16*f*, situated in the forward zone of the ring 9, by compression of the tires which are flattened as much as the force to which they are submitted is increased. On the other hand, the wheels 15 to 15*j* and 16*g* to 16*j* situated on the rear zone of the ring 9 are unloaded and their tires, which are previously compressed at the moment of mooring, tend to return to their previous circular form, so as to not loose contact with the rolling tracks 18 and 19.

In case that, as a result of the orbital movements of the swells, the ship 1 is submitted to a sliding movement, the tendency of the latter being displaced in the direction of the buoy is translated to the wheels 15*g* to 15*j* and 16*g* to 16*j* situated in the rear zone of the ring 9 by means of the pneumatic charge on the tires, which tires are deformed proportionately to the force which they receive. In the same fashion, the wheels 15 to 15*f* and 16 to 16*f* situated in the forward zone of the ring are unloaded and the tires thereof tend to return to their previous circular form, and lose the initial deformation as before, likewise for the extreme forces, do not lose contact with the rolling tracks 18 and 19.

In the case of the direction of the wind and current change, the ship 1 turns around the axis of the buoy 2 and achieves a new position. The wheels, placed in rotation, travel on the two rolling paths 18 and 19. The mooring which is realized by the device according to the invention permits equally the disassociation to a certain degree the ramming movements and tangential movements of the buoy 2 from the ship 1 thanks to the articulation at the end of the arm 5 permitted by the bearings 8 and 8*a* of connection with the ship 1 and eventually thanks to the articulation materialized by the bearings 10 and 10*a* of connection with the ring 9 carrying the wheel.

Likewise, it is possible, if suggested, to disassociate the rolling movements of the ship from those of the buoy and realize an articulation of the two forks 6 and 7 which comprise a portion of the arm 5, this articulation is permitted by the bearings 11 and 12 and the lugs 13 and 14 which are disposed along the longitudinal axis of the arm.

In the event that the ship 1 is to be released from its mooring with the buoy 2, the remote control of the hydraulic actuators 22 produces the simultaneous radial separation of the lower wheel 16 to 16*j* in a manner such that it permits raising of the arm from the position 5 to the position 5*r*. The tires of the wheels 15 to 15*j* separate from the rolling path, the ring 9 is disengaged from the ship 1 and freed.

The advantages of the present invention result essentially in the possibility of rapidly mooring a ship on a buoy already anchored, and to free the ship at will, under moderate conditions of the ocean which are statistically frequently occurring.

The device according to the invention likewise permits periodic maintenance and preventive maintenance of the connecting means arm-buoy at the level of the wheels and of their bearings, without interrupting the connection, and the removal of a wheel which is damaged, as has already been discussed, the other wheels being maintained in operating position, and replacing it with another wheel in its place.

The device for rapid mooring and freeing of a ship is particularly applicable for use in installations for the temporary production of petroleum from an underwater deposit, wherein the anchored buoy supports flexible connecting conduits 46 to 46*g* between the head of the underwater well and the surface, and where the ship is a tanker ship equipped with a plant for treating the production products.

To this effect, as represented in FIGS. 1 and 2, the transfer of the products in the ship 1 can be effectuated by means of a rotating ball and socket joint 47, of the rigid tubing 48 supported by the cables 49 and 50 so as to form a rotating arm, and flexible conduits 51, 52 and 53 which permit maintaining continuity of the transfer channel despite the relative movements of the buoy, and the two forks 6 and 7 of the rigid arm 5 of the ship 1.

Figure 4:
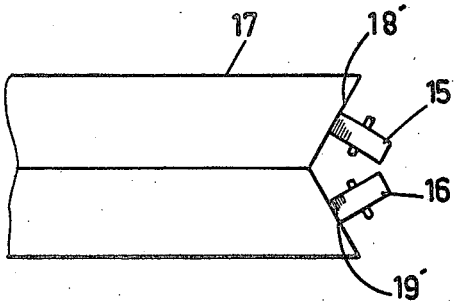
FIGS. 4 and 5 illustrate schematically two additional embodiments of the rolling pathway.

I have described hereinabove one embodiment which appears to use to be most judicious of the device for rapidly mooring according to the invention. The invention can be applied equally to other embodiments which employ elastic bands on the wheels carried by a rigid arm extending from the ship and which cooperates on a rolling path of the anchored marine installation, and notably to another embodiment where the rolling path instead of comprising the two conical walls opposed at the base for forming a ring or collar, is constituted by two truncated conical walls 18' and 19' opposed at their lower bases so as to form a hollow portion wherein the ring carrying the wheels can be imprisoned, as shown schematically in FIG. 4.

Figure 5:
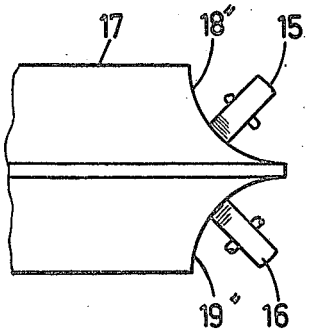

It will be equally possible, without departing from the scope of the invention, to use a circular rolling pathway having walls in either concave or convex form for guiding the wheels 15 to 15*j* and 16 to 16*j* (walls 18" and 19", FIG. 5), in place of the rolling pathway having conical walls defined hereinbefore.

I claim:

1. In a device for rapidly mooring a floating installation (1) to a floating marine installation (2) fastened to at least a fixed point at the bottom of the ocean to which said floating installation (1) is connected by means of a rigid arm (5), one of the extremities of said arm (5) being connected to the floating installation (1) at an articulated connection (8, 8*a*) having a substantially horizontal axis, and the other extremity of said arm (5) carrying connecting means (9), the improvement wherein said connecting means (9) is equipped with guiding means (15, 16) cooperating externally around with a circular rolling pathway (17) on the marine installation, said pathway being eventually located out of water and separating means for temporarily pulling way (21, 22) the guiding means (15 to 15*j*; 16 to 16*j*) carried by the connecting means (9) from the rolling pathway to permit effecting of bringing along side of the floating installation to the floating marine installation, and then for retaining said connecting means (9) on said rolling pathway (17) after the lowering of the rigid arm (5) to achieve said mooring, and for freeing of said connecting means (9) to permit the raising of the rigid arm (5) when the floating installation is to be released from the marine installation (2).

2. A device according to claim 1, wherein said guiding means carried by the connecting means (9) at the end of the rigid arm (5) comprises two trains of wheels equipped with tires (15 to 15*j*; 16 to 16*j*), the axes of said wheels of each of said trains being disposed in a manner such that said wheels are urged against distinct walls (18, 19) of the rolling pathway upon which they are guided in the mooring position.

3. A device according to claim 2, wherein the two trains of wheels (15 to 15*j*; 16 to 16*j*) are disposed one below the other in cooperation respectively with an upper wall (18) and a lower wall (19) of said rolling pathway (17).

4. A device according to claim 2, wherein the rolling pathway (17) comprises two superposed conical walls (18, 19, FIG. 3; 18', 19' FIG. 4) respectively cooperating with the two trains of wheels (15 to 15*j*; 16 to 16*j*).

5. A device according to claim 2, wherein the rolling pathway (17) comprises two truncated conical walls (18, 19, FIG. 3) opposed at their bases so as to form an edge.

6. A device according to claim 2, wherein the rolling pathway comprises at least two truncated conical walls (18' and 19') opposed at their lower bases so as to form a recess.

7. A device according to claim 2, wherein the rolling pathway (17) comprises two concave walls (18", 19", FIG. 5) cooperating respectively with the two trains of wheels (15 to 15*j*; 16 to 16*j*).

8. A device according to claim 1, 2, 3, 4, 5, 6 or 7, wherein the guiding means carried by the connecting means (9) at the end of said rigid arm are made up of two trains of wheels (15 to 15*j*; 16 to 16*j*) equipped with elastic bands, the axes of said wheels of each of said trains being disposed in such a manner that said wheels are applied against the wall (18, 19) upon which they respectively roll in position of mooring of the floating installation.

9. A device according to claim 8, wherein the separating means for temporarily pulling away the guiding means (15 to 15*j*; 16 to 16*j*) cooperates with the wheels adapted for travel on the rolling pathway (17) on the marine installation (2), said wheels being mounted on an eccentric axle (21), and wherein a remote control command means is provided for causing rotation thereof to permit the simultaneous radial disengagement of said wheels towards the exterior of the connecting means (9) on which they are carried.

10. A device according to claim 2, 3, 4, 5, 6, or 7, wherein the separating means for temporarily pulling away the guiding means (15 to 15*j*; 16 to 16*j*) cooperates with the wheels (16 to 16*j*) adapted for travel on the lower wall (19) of the rolling pathway on the marine installation (2), said wheels (16 to 16*j*) being mounted on eccentric axles (21), and wherein remote control command means is provided for causing rotation to permit the simultaneous radial disengagement of said wheels (16 to 16*j*) towards the exterior of the connecting means (9) on which they are carried.

11. A device according to claim 10, wherein each of said guiding wheels (15 to 15*j*) adapted for travel on the upper wall (18) of the rolling path (17) on the marine installation (2) is fixed on said connecting means (9) by means of an eccentric axle (35) whereby a local command from said remote control command means for rotation in one direction permits, once the connection between the marine installation (2) and the floating installation (1) is established, moving away the corresponding wheel (15) from the wall (18) which constitutes its rolling path at the time that the other wheels remain in operating position, and further permits commanding for rotation of said eccentric axle in the opposite direction for applying said wheel onto its rolling track (18).

12. A device according to claim 1, wherein the extremity of the rigid arm (5) connectable to the marine installation (2) is extended into a fork of which the two branches carry the connecting means (9), with said connecting means extending along a plane, to which they are connected by means of an articulated connection (10 10*a*) having an axis parallel to the plane of said connecting means (9).

13. A device according to claim 1, wherein the rigid arm (5) comprises two portions (6 and 7) one being an extension of the other and capable of turning one with respect to the other, the connection between said portions being ensured by means of two coaxial bearings (11, 12) and two abutments (13, 14) capable of absorbing the traction and compression forces applied to said arm (5) by the relative movement of the marine installation (2) and the floating installation (1).

14. A device according to claim 1, wherein said connecting means is a ring (9) articulated at the extremity of the rigid arm and equipped with at least one ballast (29, 29*a*) lowering its center of gravity with respect to its axis of articulation in a manner such that during operation of lowering and raising said arm (5), said connecting means (9) provides a perpendicular stability which maintains it substantially horizontal.

15. A device according to claim 2, wherein pneumatic chambers (4) are connected by means of tubings (42, 43) and a rotating connection (44) to a common installation (45) of pressurization and regulation, for adjusting the pressure of said tires (41) in relation to the charges applied therefrom in response to the condition of the ocean.

16. In a device for rapidly mooring a floating installation (1) to a floating marine installation (2) fastened to at least a fixed point at the bottom of the ocean to which said floating installation (1) is connected by means of a rigid arm (5), one of the extremities of said arm (5) being connected to the floating installation (1) at an articulated connection (8, 8*a*) having a substantially horizontal axis, and the other extremity of said arm (5) carrying connecting means (9), the improvement wherein said connecting means (9) is equipped with guiding means (15, 16) cooperating externally around with a circular rolling pathway (17) on the marine installation, said pathway eventually being located out of water and having distinct walls (18, 19), said guiding means carried by the connecting means (9) at the end of the rigid arm (5) comprising two trains of wheels equipped with tires (15 to 15*j*; 16 to 16*j*), the axes of said wheels of each of said trains being disposed in a manner for urging said wheels against the distinct walls (18, 19) of the rolling pathway, separating means (21, 22) for temporarily pulling away the guiding means (15 to 15*j*; 16 to 16*j*) carried by the connecting means (9) from the rolling pathway to permit effecting of bringing along side of the floating installation to the marine installation, and then retaining said connecting means (9) on said rolling pathway (17) after the lowering of the rigid arm (5) to achieve said mooring, and for freeing of said connecting means (9) to permit the raising of the rigid arm (5) when the floating installation is to be released from the marine installation (2); and wherein the separating means for temporarily pulling away the guiding means (15 to 15*j*; 16 to 16*j*) cooperates with the wheels adapted for travel on the rolling pathway (17) on the marine installation (2), said wheels being mounted on an eccentric axle (21) wherein a remote control command means causes rotation thereof to permit simultaneous radial disengagement of said wheels towards the exterior of the connecting means (9) on which they are carried.

17. In a device for rapidly mooring a floating installation (1) to a floating marine installation (2) fastened to at least a fixed point at the bottom of the ocean to which said floating installation (1) is connected by means of a rigid arm (5), one of the extremities of said arm (5) being connected to the floating installation (1) at an articulated connection (8, 8*a*) having a substantially horizontal axis, and the other extremity of said arm (5) carrying connecting means (9), the improvement wherein said connecting means (9) is equipped with guiding means (15, 16) cooperating externally around with a circular rolling pathway (17) on the marine installation, said pathway eventually being located out of water and having distinct walls (18, 19), said guiding means carried by the connecting means (9) at the end of the rigid arm (5) comprising two trains of wheels (15 to 15*j*; 16 to 16*j*) equipped with elastic bands, the axes of said wheels of each of said trains being disposed in such a manner that said wheels are applied against the walls (18, 19) upon which they roll in position of mooring the floating installation, separating means (21, 22) for temporarily pulling away the guiding means (15 to 15*j*; 16 to 16*j*) carried by the connecting means (9) from the rolling pathway to permit effecting of bringing along side of the floating installation to the marine installation, and then for retaining said connecting means (9) on said rolling pathway (17) after the lowering of the rigid arm (5) to achieve said mooring, and for freeing of said connecting means (9) to permit the raising of the rigid arm (5) when the floating installation is to be released from the marine installation (2), and wherein the separating means for temporarily pulling away the guiding means (15 to 15*j*; 16 to 16*j*) cooperates with the wheels adapted for travel on the rolling pathway (17) on the marine installation (2), said wheels being mounted on an eccentric axle (21) wherein a remote control command means causes rotation thereof to permit simultaneous radial disengagement of said wheels towards the exterior of the connecting means (9) on which they are carried.

* * * * *